US005632223A

United States Patent [19]

Bray et al.

[11] Patent Number: 5,632,223

[45] Date of Patent: May 27, 1997

[54] PROTECTIVE COVERING SYSTEM

[76] Inventors: Ernest R. Bray, 1129 E. 400 North, Orem, Utah 84057; Bradley S. Hustead, 1571 S. 400 East, Orem, Utah 84058

[21] Appl. No.: 339,561

[22] Filed: Nov. 15, 1994

[51] Int. Cl.[6] ..... B63B 17/00

[52] U.S. Cl. ..... 114/361; 150/166

[58] Field of Search ..... 114/361; 150/166, 150/154; 410/96, 97

[56] References Cited

U.S. PATENT DOCUMENTS

| | | | |
|---|---|---|---|
| 2,442,266 | 5/1948 | Davis | 280/179 |
| 2,455,237 | 11/1948 | Davis | 150/154 |
| 3,698,409 | 10/1972 | Koontz et al. | 114/361 |
| 4,292,913 | 10/1981 | Siebert et al. | 114/361 |
| 4,630,990 | 12/1986 | Whiting | 410/96 |
| 4,938,522 | 7/1990 | Herron et al. | 150/166 |
| 5,228,408 | 7/1993 | Jannmausch | 114/361 |
| 5,458,447 | 10/1995 | Clason | 410/97 |

OTHER PUBLICATIONS

Winch Strap Assemblies, Ancra International, Aug. 19, 1990.

*Primary Examiner*—Sherman Basinger
*Attorney, Agent, or Firm*—Brick G. Power

[57] ABSTRACT

The present invention is directed to a protective covering system for an object subject to exposure to the elements. The protective cover comprises a body, at least one strap, a drawstring or elastic cord for holding the bottom edge of the body tightly against the object being covered, and at least one universal clip per strap. The strap is connected to the body. The universal clip is attached to the strap. The clip attaches to the object being covered and the strap is tightened over the object. This combination works in concert to secure the protective cover over the object that is being covered in a manner superior to that of existing protective covers.

18 Claims, 4 Drawing Sheets

PROTECTIVE COVERING SYSTEM

BACKGROUND

1. Field of Invention

This invention relates to systems for the protective covering of objects that are transported or stored in the open and subject to exposure.

2. Description of Prior Art

Existing protective covers employ simple means for securing the cover to the object. First, the most common means for securing protective covers involves using rope, twine, elastic cords, straps, etc. The securing means must then be passed beneath the object being covered in order to secure the cover to the object. Another means for securing the protective cover requires that some type of hook or eyelet be attached to the object to be covered. The cover can then be secured to the object by using rope, twine, elastic cords, straps, etc. The existing means for securing covers require extensive manipulation in order to secure the cover over the object which is to be covered and protected. These methods are time consuming, inconvenient, and ineffective.

The prior art means for securing the cover can be easily lost or misplaced. They often become tangled and unusable.

An example of the problems associated with the prior art can be demonstrated by using the example of a personal watercraft. The watercraft must first be attached to a trailer before the cover can be placed over the watercraft. This is because personal watercraft are secured to a trailer using a nose pin. This creates difficulty since the existing covers do not provide a means whereby the cover can be placed over or removed from the watercraft while the watercraft is not secured to the trailer. The primary difficulty created by the existing covers is that their securing means must be passed under the watercraft or under the trailer. This requires either lifting the watercraft or climbing under a trailer on which the watercraft is stored. But one of these two options is a necessity since the existing covers secure beneath the object rather than over it. An additional problem with existing covers occurs during transport. When transporting the covered object, air is forced under the cover and the cover "chatters" back and forth across the object. Chattering is the rapid movement of the cover due to the instability of the securing means.

Using the example of a watercraft, this movement of the cover across the watercraft damages the finish and other parts of the watercraft. Over a short period of time, substantial damage may occur to any object that is covered using existing means. In addition, the existing covers wear and age rapidly, diminishing their functionality and usefulness.

Finally, at highway traveling speeds, the force of wind under and around the present covers often results in the cover being blown off or flapping in the air, no longer covering the object to which it is attached.

The disadvantages identified above are not isolated to this example, but extend to protective covering systems for other objects as well.

What is needed is a protective covering system that 1) is easily placed on and removed from an object to be covered and 2) secures snugly to the object being covered, eliminating damage to that object and reducing wear of and loss of the protective cover, while reducing the time and effort used in covering the object.

SUMMARY

This invention satisfies the needs identified above. It is an improved protective covering system for objects that are subject to exposure during transport or while in storage. Its design allows for simple placement on and removal from the object to be covered. It secures above the object to be covered rather than beneath the object. It secures snugly to the object for dramatically increased protection and provides a longer wearing time and greater durability.

A preferred embodiment of the invention comprises:

a) A body, preferably having a construction that is form-fitted to match the contours of the object being covered;

b) At least one strapping means that extends over the body of the cover; or, preferably, a plurality of strapping means that are strategically placed to optimally reduce the amount of air that may blow under the cover during transport or in winds.

c) The above strapping means, having universal clips attached at each portion of the strapping means that must be secured to the object, the universal clips having a structure and dimensions that provide for maximum securability and easy removability of the cover from the object being covered.

OBJECTS AND ADVANTAGES

The protective covering system provides the following advantages over the prior art:

(a) a more convenient covering system, which can be quickly and easily installed over objects since it secures from above the object to be covered rather than beneath the object;

(b) a more secure and reliable protective cover for objects that need covering; and (c) a covering system that provides greater protection to the object that it covers without causing as much damage as the prior art.

The protective covering system may also provide the following advantages over the prior art:

(a) a more durable cover system, made from materials that will not rapidly fade or deteriorate when exposed to the elements and will not develop a rough surface that could damage the object being covered; and (b) a covering system that will not be blown off or dislodged from the object being covered when the object is transported or subject to winds.

Further advantages of the present invention will become apparent from a consideration of the drawing and ensuing description.

DRAWING FIGURES

DESCRIPTION

Figure 1:
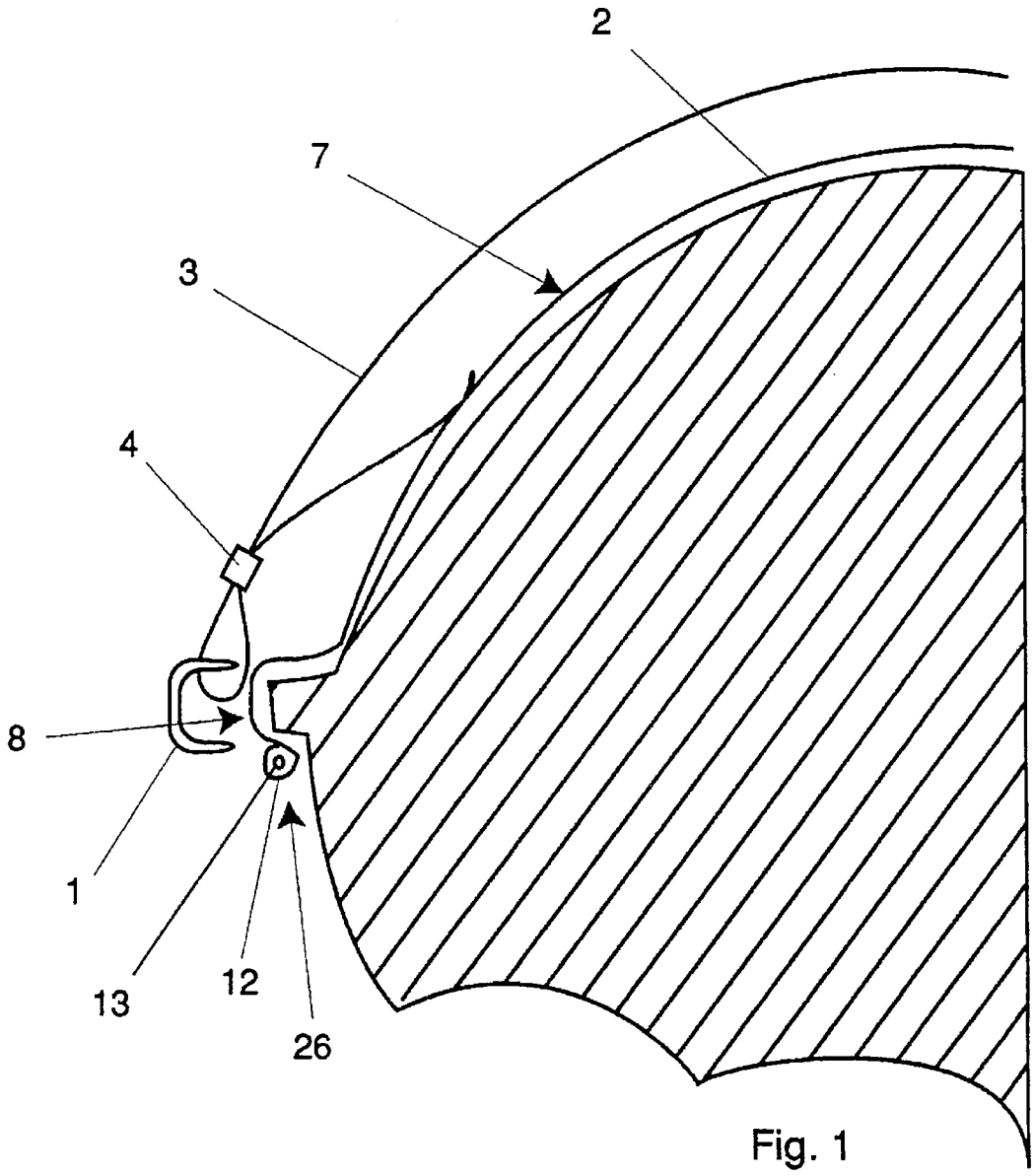
FIG. 1 shows the basics of the Protective Covering System and demonstrates how its elements function.
Figure 2:
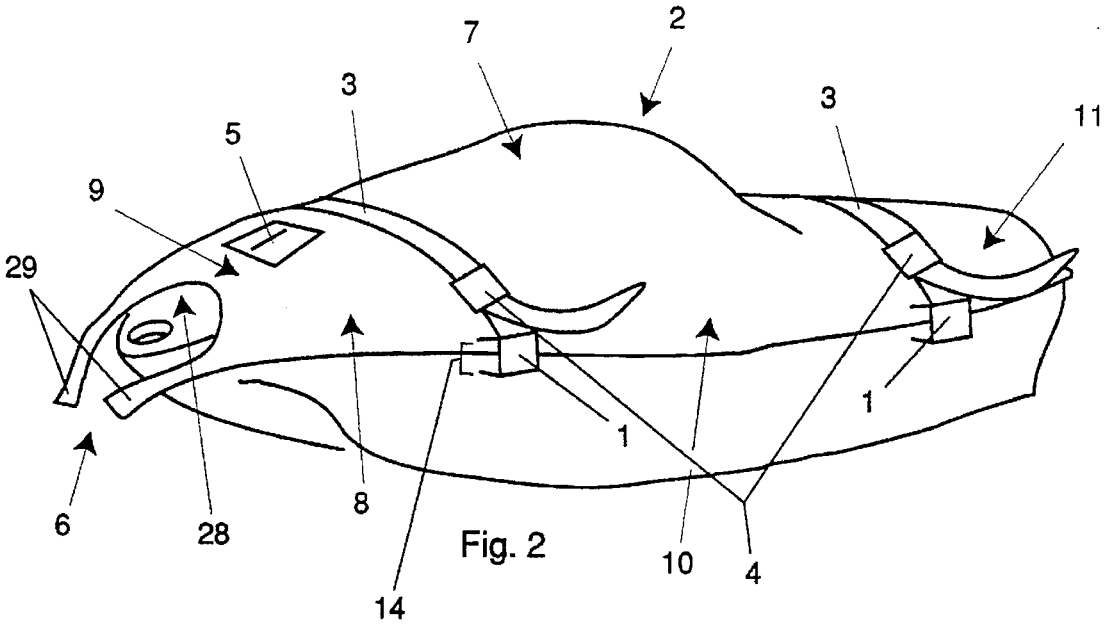
FIG. 2 shows a first embodiment of a Protective Covering System.
Figure 3:
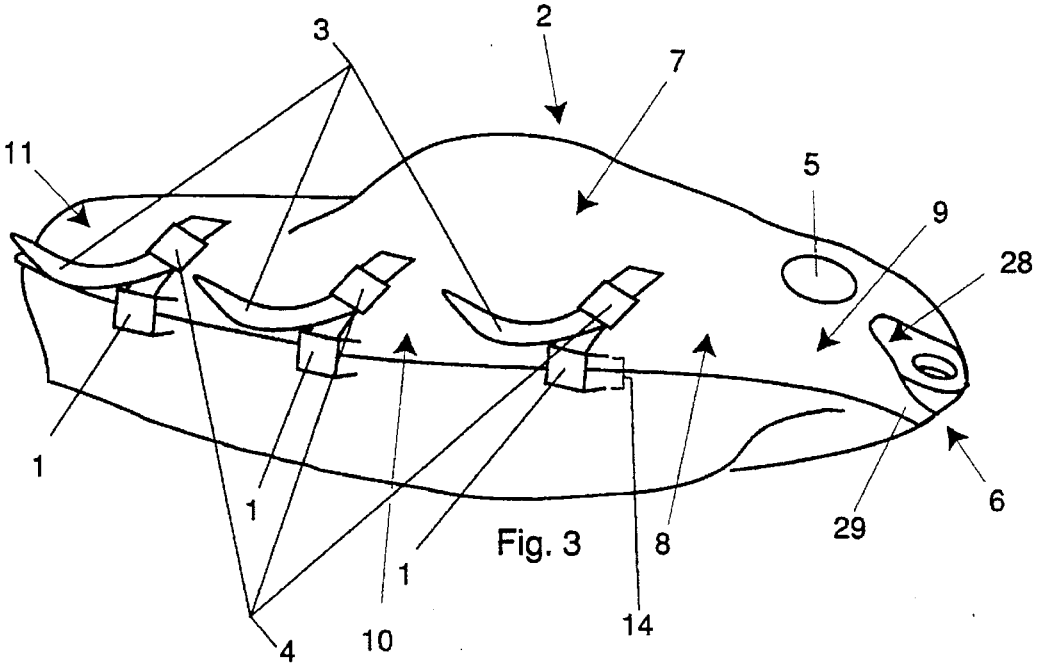
FIG. 3 shows a second embodiment of the Protective Covering System.

The present invention is directed to a protective covering system for objects. It is especially useful for protecting objects that are subject to exposure during storage or transport.

The protective covering system utilizes a combination of straps and clips to quickly and efficiently secure a protective cover to an object.

The protective covering system comprises a body (2), at least one means for strapping (3) extending over the body, at least one universal clip (1) attached to each means for strapping, a means for tightening and securing the straps (4), and a means for tightening the cover's body around the object to be covered (26).

The body can be made from a variety of materials, including fabrics, plastics, foams, rubbers, foam rubbers, etc. The preferred embodiment of the body material is one that will not wear or otherwise cause damage to the object being covered. For example, a material cover of textured polyester of at least 600 denier having a vinyl-laminated backing would provide the desired protection. The body can be made from either a single piece or from multiple panels. One should be able to cover an object, or the desired portion thereof, with the body in a manner that the body will fit or mold to the object's form. The body may consist of simply a top portion (7) and a bottom edge (8), or it may have a top portion, a bottom edge, a plurality of side portions (10), a front portion (9), and a rear portion (11). Or a body may have any intermediate combination of the aforementioned portions.

For convenience purposes, the body could include any number of access panels (5). Access panels create a means whereby a person can access certain parts of the object being covered without having to remove the cover. Using the personal watercraft example, access panels may be placed at positions that would allow a person to attach or detach the watercraft from a transport trailer and covering the gas cap for ease in refueling the watercraft while in transport.

Figure 4:
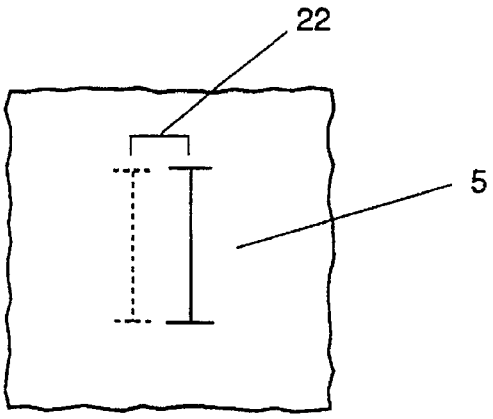
FIG. 4 shows a first embodiment of an access panel.
Figure 5:
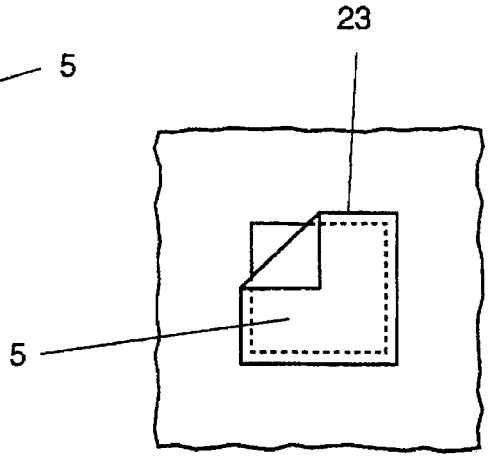
FIG. 5 shows a second embodiment of the access panel.
Figure 6:
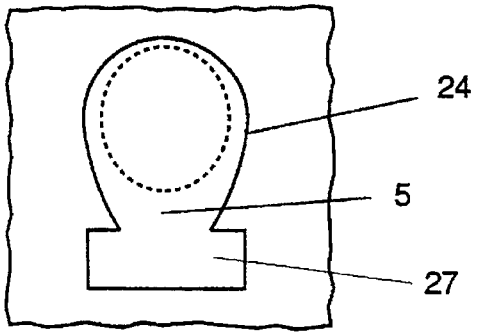
FIG. 6 shows a third embodiment of the access panel.
Figure 7:
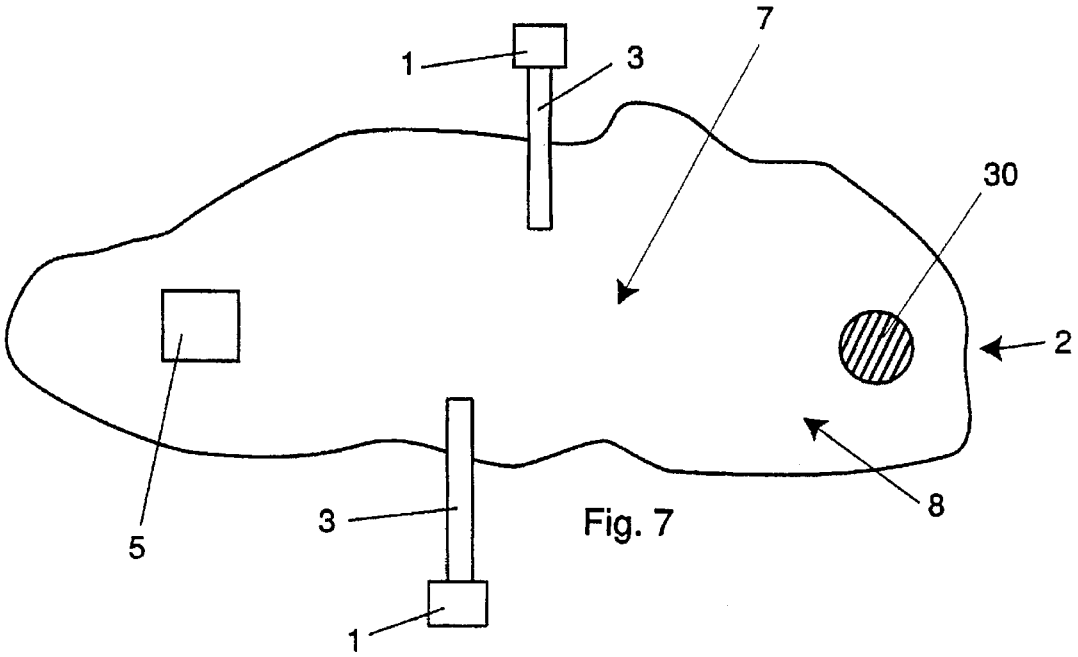
FIG. 7 shows a third embodiment of the Protective Covering System.
Figure 8:
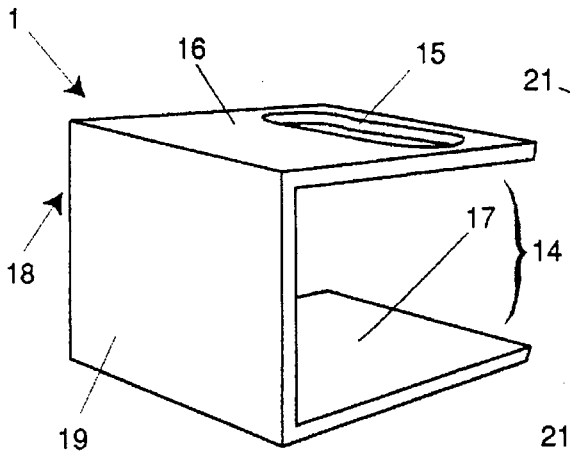
FIG. 8 shows a first embodiment of a Universal Clip.
Figure 9:
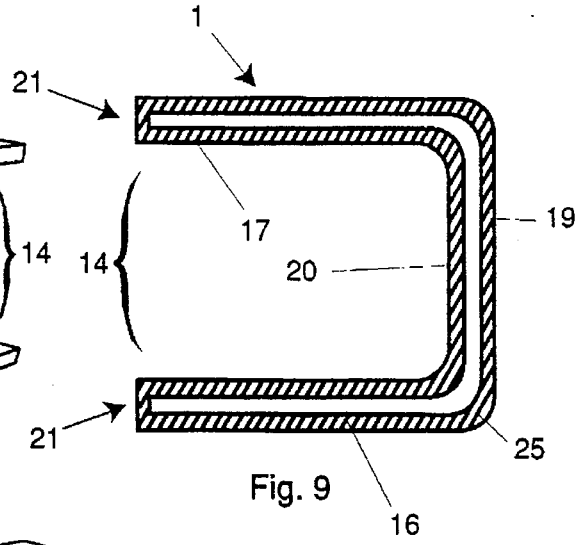
FIG. 9 shows a second embodiment of the Universal Clip.
Figure 10:
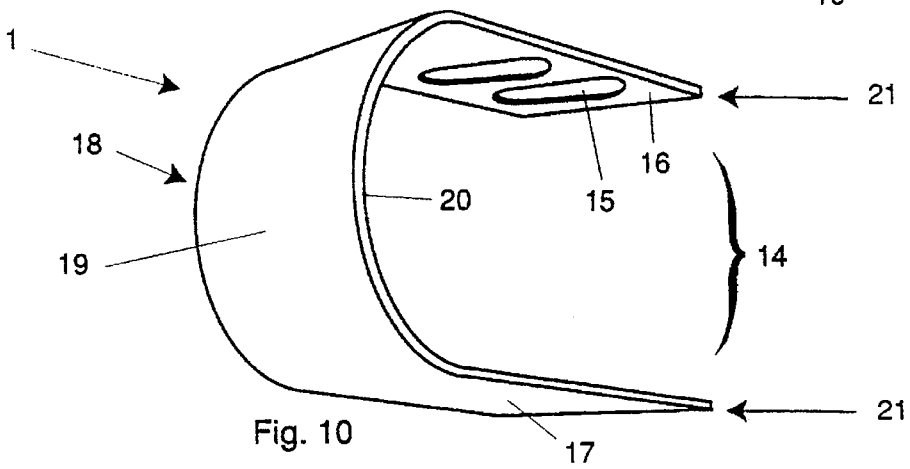
FIG. 10 shows a third embodiment of the Universal Clip.
Figure 11:
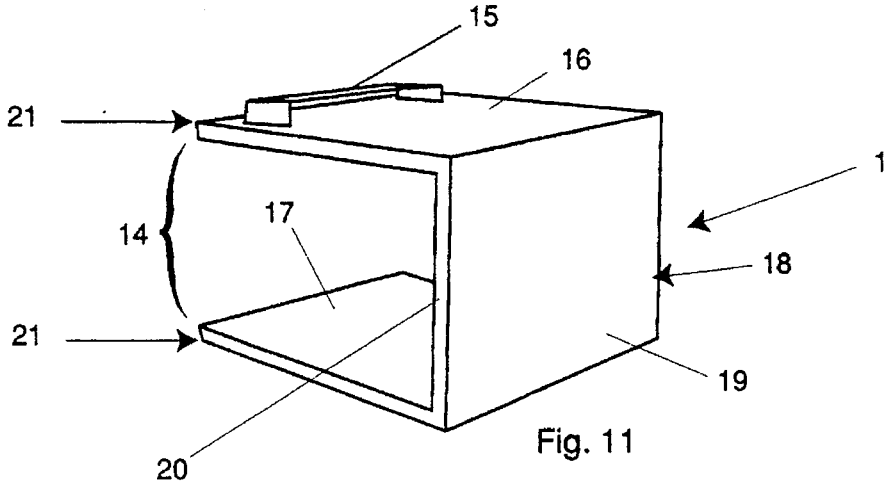
FIG. 11 shows a fourth embodiment of the Universal Clip.

Access panels may be fixedly attached to the body (FIG. 4) or partially removably attached (FIG. 6) or completely removably attached (FIG. 5) to the body. First, fixedly attached access panels must consist of a means whereby a person can access the desired portions of the covered object. For example, an access panel could be constructed from a two pieces of stretchable or flexible material which create a flap (22) that have enough of an overlap to keep the elements from getting under the cover, but still permitting one to gain the desired access to the object beneath. Next, completely removably attached access panels are connected to the body using a means for fastening the access panel to the body (23) in a manner that will withstand high speeds and high winds. For example, the panels could be fastened using zippers, snaps, hooks and loops, etc. Last, partially removably attached access panels have a portion permanently affixed to the body (27), and have a large enough portion removably attached that a person can gain the desired access to the object beneath. The removably attached portion of these access panels employ a means for fastening the access panel to the body (24).

The body may also include a means for securing the bottom edge around the object being covered. Such a means would ensure that the cover fits snugly around the covered object. Examples of the means for securing the cover's bottom edge include a plurality of loops or a single loop (12) that extends substantially the entire length of the bottom edge. The loop or loops engage a drawstring, an elastic band, or some other means for securing the body around the covered object (13). Other means for securing the bottom edge around the object could also be employed.

The body may also include any number of embracers (6). Embracers are formed by openings or incisions on the body at its bottom edge, extending towards the top portion, thereby creating an embracing portion (28) and two bottom portions (29). A means for securing the two bottom portions is located on the two bottom portions. Embracers may be located anywhere along the bottom edge of the body. Embracers may function to allow for easy installation and removal, for easy access, for a better fit, or for any other purpose.

The body may also have any number of openings (30). Openings are created by the portions of the body that surround a hole in the body. Openings may be included for any purpose, including, but not limited to the following: for easy installation and removal, for easy access, and for a better fit. An example of a functional opening would be an opening on the rear portion of a personal watercraft cover that allows for a tie down fastener to pass through the rear portion of the body so that the cover may also be secured to a trailer.

The protective covering system may have one or more means for strapping the body to the object being covered ("means for strapping" or "strapping means"). The means for strapping may be fixedly attached, slidingly attached, or unattached to the body. The means for strapping have two ends and a central portion.

Slidingly attached means for strapping must be slidingly engaged by at least one attachment means that is fixed to the body. Sliding engagement is defined as the attachment, by a means for attachment, of strapping means to the body in a manner that allows movement through the means for attachment to allow movement of the means for strapping for tightening purposes. Slidingly attached strapping means and unattached strapping means must extend at least the substantial length of the body from bottom edge, across the top, to the opposite bottom edge.

Fixedly attached strapping means may be fixed to the body anywhere top-ward from the bottom edge. They may have two loose ends and extend over the top of the body, reaching substantially to the bottom edge, or a greater distance, on opposing sides of the body. Alternatively, fixedly attached means for strapping may not extend completely over the top portion of the body, whereby a set of straps would make up a single means for strapping. A set is defined as at least the number necessary to appropriately attach the protective covering system to the object. Such means for strapping would extend from the point of fixation, where one of the ends is fixed to the body, substantially to the bottom edge, or a greater distance.

Universal Clips are designed to attach to some portion of the object to be covered. For example, on protective covering systems for personal watercraft, boats, and snow mobiles, the Universal Clips have the appropriate dimensions for fitting over and grasping onto a lip located on the sides of the personal watercraft, boat, or snowmobile. As part of the protective covering system, Universal Clips are attached to the means for strapping. Universal clips can be easily attached to the object and easily removed from it. Yet, when the means for strapping are tightened, an upward pressure will be exerted on the Universal Clip, tightly securing the protective covering system to the object.

Universal clips are made from materials that resist flexing and bending and breaking. Such materials are desired due to their ability to withstand the pressure placed on the clips and to ensure that the cover remains securely attached to the object. For example, machined aircraft-strength aluminum provides the desired results. The thickness of the materials used is not critical to the functionability of the Universal Clips. However, the clips should be made from thick enough materials to withstand the force that will be exerted thereon.

Universal Clips are substantially U-shaped, having two arms (21) and a central portion (18). The arms have an inner surface (17) and an outer surface (16). Likewise, the central portion has an inner surface (20) and an outer surface (19). The inner surfaces of the two arms and the central portion taken together form an object-receiving portion (14). The width of the arms and the central portion may vary so long as the universal clip remains functional. The size of the object-receiving portion, measured as the distance from the inner surface of one arm to an opposing point on the inner surface of the second arm, varies according to the lip size of the object to be covered.

The means for strapping may attach to the universal clip by a means for engaging the means for strapping (15). The various embodiments of the means for engaging the means for strapping include, but are not limited to: 1) an extension on the outer surface of one of the arms; 2) a plurality slots located on one of the arms, through which the means for strapping can pass to engage the Universal Clip; 3) extending the means for strapping into the object-receiving portion of the Universal Clip; and 4) a single slot located on one of the arms of the Universal Clip.

The Universal Clips may also be painted or coated (25). The coating may be used for aesthetic purposes or for added protection.

The means for engaging the means for strapping of the Universal Clips can either fixedly engage the means for strapping or slidingly engage the means for strapping. This depends only upon the chosen means for tightening and securing the strapping means. The Universal Clips are located at or near the loose end of each means for strapping, at a position that will allow for easy placement on and removal from the lip of the object to be covered.

The means for strapping must have located thereon a means for tightening and securing the strapping means into place. These two means may be combined or separate. The means for securing the means for strapping into place must retain enough tension in the strapping means to keep the cover secured over the object. For example, a sinch buckle could be used to provide the desired results.

The best mode of the protective covering system includes a means for strapping that extends completely over the body. Both ends of the means for strapping are fixedly attached to the bottom edge of the body on opposing sides of the body. A tightening means is located on the means for strapping. The means for strapping is slidingly engaged by a Universal Clip located at near the bottom edge-means for strapping attachment.

When this mode is employed, the covering system is most effective. The body is pulled to a greatly increased tautness, which reduces the amount of air that can be blown under the cover and reduces the amount of chattering. The protective covering system's parts function in concert to provide these results, which make the protective covering system greatly superior to the existing covers.

First, the Universal Clips latch onto a lip on the object to be covered, holding the Universal Clip stationary while the means for strapping is tightened. Next, the fixed attachment of the means for strapping allows the slack to be pulled from the cover when the means strapping is tightened. When the means for strapping is tightened, pressure is exerted upward on the Universal Clip, securing it to the object to be covered. In addition, since the Universal Clip remains in place, when the means for strapping is tightened, it is pulled through the Universal Clip, which allows the cover to be pulled downward since each end of the means for strapping is fixedly attached at the bottom edge of the cover.

Although the description above contains many specificities, these should not be construed as limiting the scope of the invention, but as merely providing illustrations of some of the presently preferred embodiments of this invention. For example, this type of illustration was used to illustrate a protective covering system for personal watercraft, which is only one embodiment of the protective covering system. Likewise, such an example of machined aircraft-strength aluminum was used to describe a material from which to construct the Universal Clips, which may be made from any material that would allow the protective covering system to retain its functionality.

Thus the scope of the invention should be determined by the appended claims and their legal equivalents, rather than by the examples given.

What is claimed is:

1. A combination including a protective covering system for covering personal watercraft and a personal watercraft, wherein the protective covering system is adapted to be secured only to the personal watercraft so that the watercraft may be moved with the covering thereon, the protective covering system comprising:

a) a body having a top portion and a bottom edge;

b) at least one means for strapping having two ends, at least one of which is a loose end, the means for strapping extending at least partially over the top portion of the body;

c) a universal clip having two substantially parallel arms and a central portion which connects the arms, and a means for attaching the means for strapping, the arms and the central portion having an inner surface and an outer surface, the inner surface of the arms and the central portion forming an object-receiving portion, the universal clip being attached at the means for strapping; and d) a means for tightening and securing the means for strapping, which engages the means for strapping, whereby the body is secured tightly over the upper portion of the watercraft.

2. The combination described in claim 1, the body further comprising at least one access panel.

3. The combination described in claim 1, the body further comprising at least one embracer, the embracer extending from the top portion of the body to the bottom edge of the body, the embracer having an embracing portion and two bottom portions.

4. The combination described in claim 1, the means for strapping further comprising a plurality of straps, spaced from each other to secure the body on the watercraft.

5. The combination described in claim 1, whereby the means for attaching the means for strapping is located on one of the arms of the universal clip, the means for attaching the means for strapping slidingly engaging the means for strapping.

6. The combination described in claim 1, wherein the means for tightening and securing the means for strapping comprises a cinch buckle located on the means for strapping.

7. The combination as described in claim 1, further comprising a means for tightening the body around the watercraft, located at the bottom edge of the body.

8. A combination including a personal watercraft having at least two edges and a self-contained protective covering system for covering the watercraft by attaching only to the watercraft, comprising:

(a) a flexible cover shaped to substantially cover a portion of the watercraft between the two edges, (b) a plurality of straps extending over a portion of the cover, each strap having at least two loose ends, (c) a fastener attached to each loose end of the straps, and shaped to fit over one of the edges of the watercraft, and (d) tightening means on the straps for shortening the straps so as to secure the cover tightly over the watercraft.

9. The combination of claim 8 wherein the flexible cover is shaped to substantially form-fit the contours of the watercraft between the two edges.

10. The combination of claim 8 wherein the straps are secured directly to the cover.

11. The combination of claim 8 wherein the fastener is a U-shaped clip having parallel sides for fitting over the edge of the watercraft.

12. The combination of claim 11 wherein each strap is connected to the clip so as to slide relative to the clip to enable the strap to be adjusted in length while attached to the clip.

13. The combination of claim 8 and further comprising a cinch means around the edge of the cover to cinch up the cover edge snugly against the watercraft.

14. The combination of claim 8 and further comprising embracer means on the cover for snugly surrounding a protruding shaped portion of the watercraft.

15. The combination of claim 14 wherein the embracer means includes an opening adapted to accommodate the protruding shaped portion of the watercraft and at least two extension members adapted to surround the protruding shaped portion and connect together.

16. The combination of claim 8 and further including an access panel at least partially removably attached to the cover to enable access to portions of the watercraft.

17. A combination including a personal watercraft having at least two edges and a self-contained protective covering system for covering the watercraft by attaching only to the watercraft, comprising:

(a) a flexible cover shaped to substantially form-fit the contours of the watercraft between the two edges, (b) a plurality of Straps attached to the cover, each strap having at least two loose ends, (c) a fastener shaped to fit over one of the edges of the watercraft and slidably attached to each loose end of each strap to enable the strap to be shortened while attached to the fastener, and (d) tightening means on at least one of the straps for shortening the effective strap length extending between the two edges so as to firmly secure the cover on the watercraft.

18. The combination of claim 17 wherein the cover is shaped to cover the edges of the watercraft and the fastener is shaped to fit over one of the edges of the watercraft with the cover thereon.

* * * * *